US010979820B2

(12) United States Patent
Wang

(10) Patent No.: US 10,979,820 B2
(45) Date of Patent: Apr. 13, 2021

(54) SPEAKER

(71) Applicant: AAC Technologies Pte. Ltd., Singapore (SG)

(72) Inventor: Yanlong Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/705,230

(22) Filed: Dec. 6, 2019

(65) Prior Publication Data

US 2020/0213754 A1 Jul. 2, 2020

(30) Foreign Application Priority Data

Dec. 29, 2018 (CN) ..... 201811633498.X

(51) Int. Cl.
*H04R 1/28* (2006.01)
*H04R 9/06* (2006.01)
*H04R 1/02* (2006.01)

(52) U.S. Cl.
CPC ..... *H04R 9/06* (2013.01); *H04R 1/02* (2013.01); *H04R 1/288* (2013.01); *H04R 2400/11* (2013.01); *H04R 2499/11* (2013.01)

(58) Field of Classification Search
CPC combination set(s) only.
See application file for complete search history.

(56) References Cited

U.S. PATENT DOCUMENTS 10,349,167 B2 * 7/2019 Wilk ..... H04R 1/288
10,582,297 B2 * 3/2020 Wang ..... H04R 1/023

FOREIGN PATENT DOCUMENTS

CN 108551635 A1 9/2018

OTHER PUBLICATIONS

PCT search report dated Jun. 27, 2019 by SIPO in related PCT Patent Application No. PCT/CN2018/125243 (4 Pages).

* cited by examiner

*Primary Examiner* — Amir H Etesam
(74) *Attorney, Agent, or Firm* — W&G Law Group LLP

(57) ABSTRACT

A speaker includes an upper housing; a lower housing assembled with the upper housing to define a receiving space; and a speaker unit received in the receiving space and including a diaphragm. The upper housing includes a top wall, a side wall extending from the top wall towards the lower housing, and a blocking wall extending from the top wall along a direction facing away from the top wall and spaced apart from the side wall. The blocking wall, side wall and top wall define a receiving portion receiving the speaker unit. A breathable spacer is provided at an end of the top wall and is spaced apart from the lower housing to form first sound absorbing cavity. A side of the blocking wall facing away from the speaker unit, the side wall and the lower housing define second sound absorbing sound cavity communicating with the second sound absorbing cavity.

10 Claims, 4 Drawing Sheets

SPEAKER

TECHNICAL FIELD

The present disclosure relates to the field of electric-acoustic technologies, and in particular, to a speaker used in portable electronic products.

BACKGROUND

In the rapid development of mobile devices such as mobile phones, tablet computers and laptops, people have higher and higher functional requirements on the products. In order to highlight the entertainment effect, more and more speakers adopt a structure combined with a housing so as to obtain a better experience of low frequency.

In order to obtain a better acoustic effect, the speaker in related art is often filled with a sound absorbing material in its internal cavity, and then the sound absorbing material is encapsulated by a breathable gauze. However, the capacity of the internal cavity is often limited by the material and thickness of a cover plate thereof, a too small capacity may limit the amount of sound absorbing material that can be received, and thus the speaker cannot obtain a better acoustic effect. Further, components such as the breathable gauze for encapsulating the sound absorbing material are easily detached from the housing, causing that the sound absorbing material enters internal space of the speaker, thereby seriously affecting the acoustic performance of the speaker.

Therefore, it is necessary to provide a new structure to solve the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

Reference signs: 100, speaker; 11, upper housing; 110, receiving portion; 111, top wall; 112, side wall; 113, first blocking wall; 114, second sound absorbing cavity; 115, sound outlet; 116, front cavity; 12, lower housing; 121, bottom wall; 1211, plastic body; 1212, metal plate; 122, side plate; 123, second blocking wall; 124, first sound absorbing cavity; 125, communication port; 126, abutting portion; 127, filling hole; 128, sealing sheet; 13, speaker unit; 131, diaphragm; 14, breathable spacer; 15, buffer member.

DESCRIPTION OF EMBODIMENTS

The present disclosure will be further illustrated with reference to the accompanying drawings and the embodiments.

Figure 1:
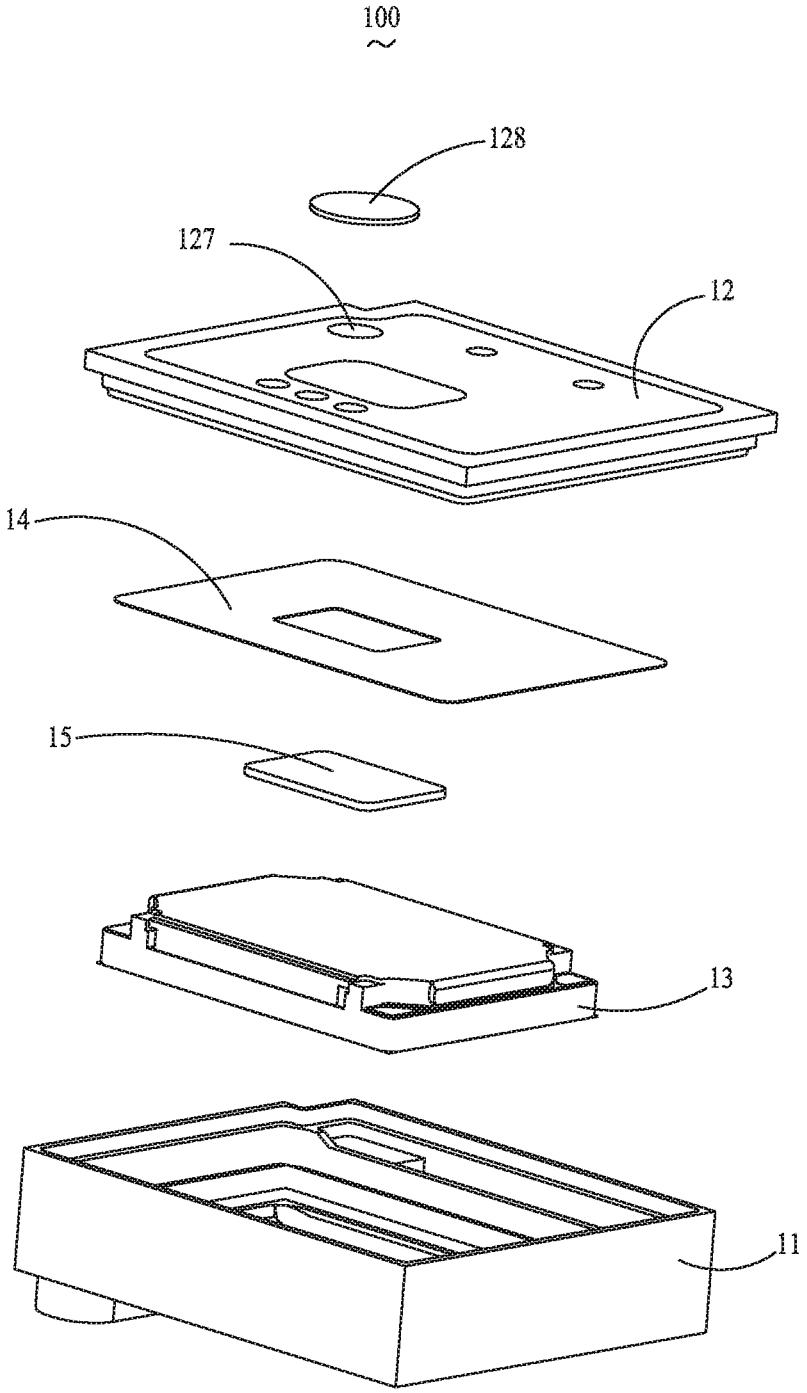
FIG. 1 is an exploded schematic view of a speaker according to an embodiment of the present disclosure.

As shown in FIG. 1, a speaker 100 according to an embodiment of the present disclosure includes an upper housing 11, a lower housing 12, a speaker unit 13, and a breathable spacer 14. The lower housing 12 is assembled with the upper housing 11 to define an receiving space.

Figure 2:
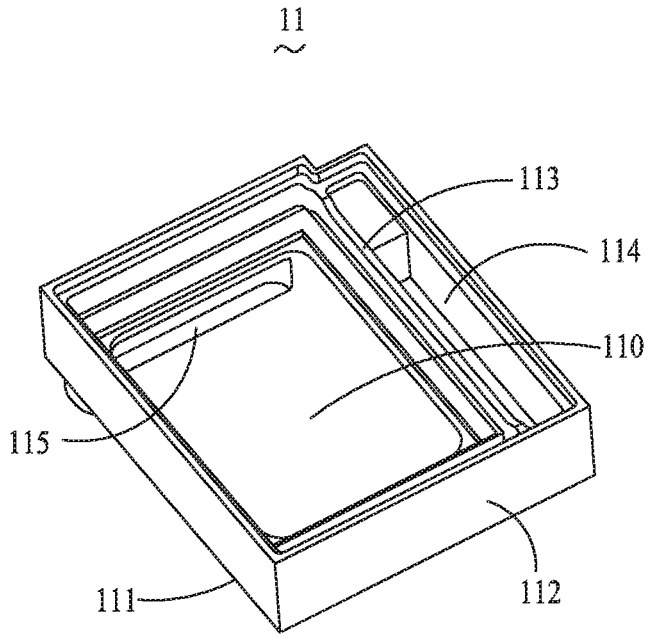
FIG. 2 is a structural schematic view of an upper housing of a speaker according to an embodiment of the present disclosure.

As shown in FIG. 2, the upper housing 11 includes a top wall 111, a side wall 112 and a first blocking wall 113. The side wall 112 extends from the top wall 111 towards the lower housing. The first blocking wall 113 extends from the top wall 111 along a direction facing away from the top wall 111 and is spaced apart from the side wall 112. The top wall 111, the side wall 112 and the first blocking wall 113 define a receiving portion 110 for receiving the speaker unit 13. A side of the first blocking wall 113 facing away from the speaker unit 13, the side wall 112 and the lower housing 12 define a second sound absorbing cavity 114 for receiving a sound absorbing material. The top wall 111 of the upper housing 11 is correspondingly provided with a sound outlet 115.

Figure 5:
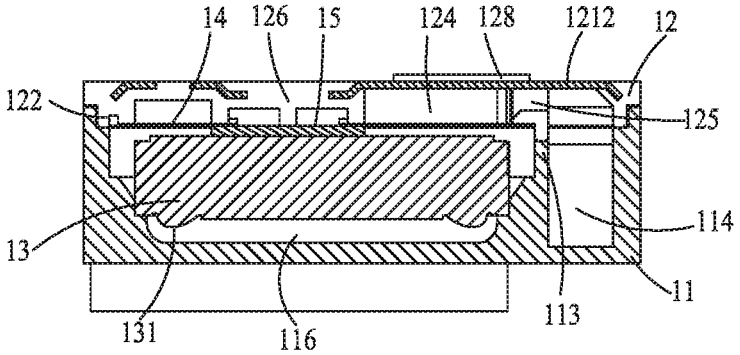
FIG. 5 is a cross-sectional view of a speaker taken along line A-A according to an embodiment of the present disclosure.

Referring to FIG. 5, the speaker unit 13 is received in the receiving portion 110. The speaker unit 13 includes a diaphragm 131. The diaphragm 131 faces the top wall 111 of the upper housing 11 and is spaced apart from the top wall 111 of the upper housing 11 to form a front cavity 116.

Figure 3:
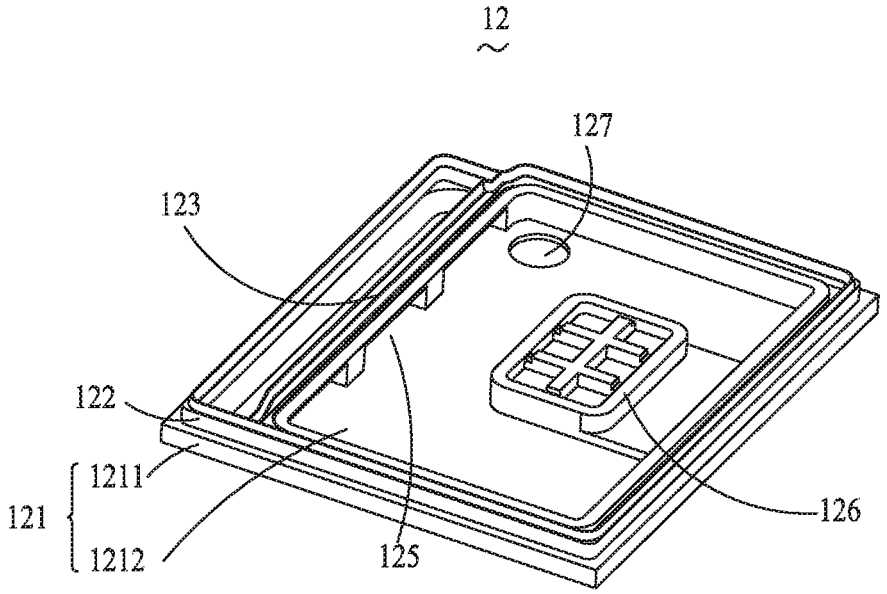
FIG. 3 is a structural schematic view of a lower housing of a speaker according to an embodiment of the present disclosure.
Figure 4:
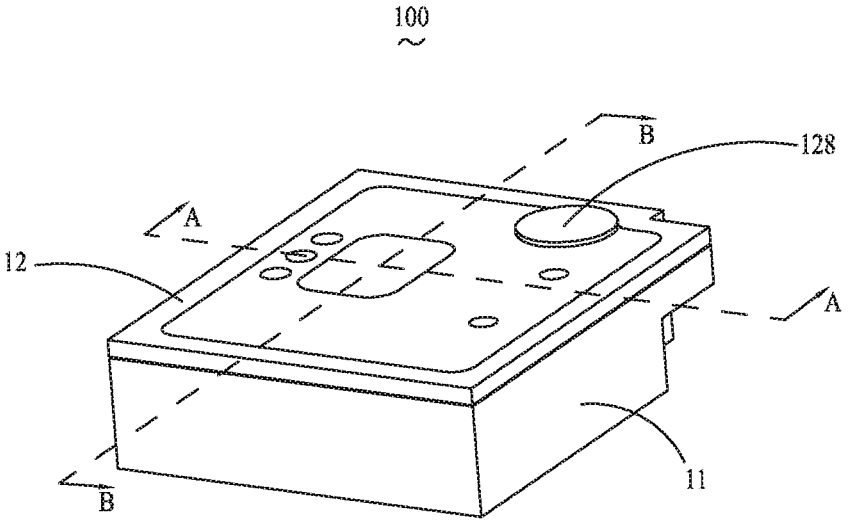
FIG. 4 is a schematic view of assembling of a speaker according to an embodiment of the present disclosure.

Referring to FIGS. 3 and 5, the lower housing 12 includes a bottom wall 121, a side plate 122, and a second blocking wall 123. The bottom wall 121 faces the top wall 111 of the upper housing 11. The side plate 122 extends from the bottom wall 121 towards the top wall 111. The second blocking wall 123 extends from the bottom wall 121 into the receiving space. The second blocking wall 123 is correspondingly welded to the first blocking wall 113. The side plate 122 is correspondingly welded to the side wall 112. The breathable spacer 14 is fixed to the second blocking wall 123 by hot melting. The breathable spacer 14 is spaced apart from the lower housing 12 to form a first sound absorbing cavity 124 for receiving the sound absorbing material. The second blocking wall 123 is provided with a communication port 125. The communication port 125 communicates the first sound absorbing cavity 124 with the second sound absorbing cavity 114.

The lower housing 12 further includes an abutting portion 126 extending from the bottom wall 121 towards the speaker unit 13. The breathable spacer 14 is fixed to the abutting portion 126. In an embodiment, the bottom wall 121 includes a plastic body 1211 and a metal plate 1212 embedded in the plastic body 1211. The metal plate 1212 and the plastic body 1211 are integrally injection-molded by means of insert molding. The lower housing 12 is provided with a filling hole 127 at a position corresponding to the first sound absorbing cavity 124 and the filling hole 127 extends through the lower housing 12. The sound absorbing material is charged into the first sound absorbing cavity 124 and the second sound absorbing cavity 114 through the filling hole 127. The lower housing 12 is further provided with a sealing sheet 128 covering the filling hole 127.

Figure 6:
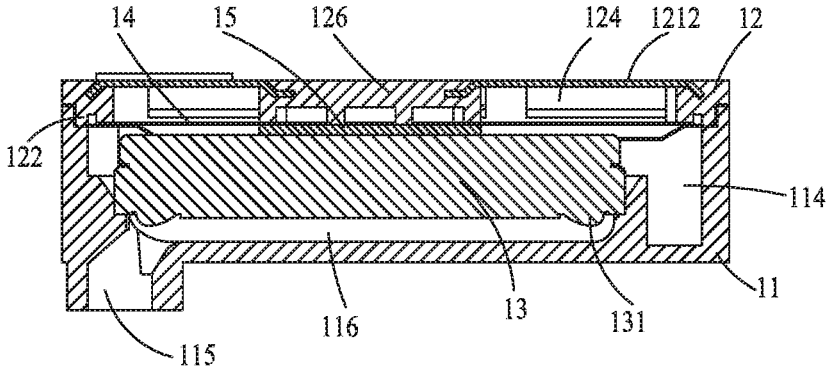
FIG. 6 is a cross-sectional view of a speaker taken along line B-B according to an embodiment of the present disclosure.

Referring to FIGS. 5 and 6, the speaker 100 further includes a buffer member 15. The buffer member 15 encapsulates the speaker unit 13 in the receiving portion 110. The breathable spacer 14 is correspondingly fixed to a periphery of the abutting portion 126 and is provided with a hollow portion corresponding to the abutting portion 126. The buffer member 15 is arranged under the hollow portion and abuts against the speaker unit 13. The abutting portion 126 is abutted against the buffer member 15 after partially passing through the hollow portion.

It is also conceivable that the breathable spacer 14 may not have the hollow portion in the middle. The buffer member 15 is directly attached to an upper surface or a lower surface of the breathable spacer 14, for elastically abutting between the lower housing 12 and the speaker unit 13.

Upon installing, the breathable spacer 14 is fixedly connected to the second blocking wall 123 of the lower housing 12. The upper surface of the hollow portion of the breathable spacer 14 is fixed to the periphery of the abutting portion 126. The buffer member 15 is fixedly attached under the hollow portion of the breathable spacer 14. The speaker unit 13 is mounted in the receiving space 110 of the upper housing 11. The first blocking wall 113 of the upper housing 11 is fixedly connected to the second blocking wall 123 of the lower housing 12 by ultrasonic welding or laser welding, and the side wall 112 of the upper housing 11 is fixedly connected to the side plate 122 of the lower housing 12 by ultrasonic welding or laser welding, so that the upper housing 11 is fixedly connected to the lower housing 12. The sound absorbing powder is injected through the filling hole 127 of the lower housing 12 and fully fills the first sound absorbing cavity 124 and the second sound absorbing cavity 114. After the powder filling is completed, the sealing sheet 128 seals the filling hole 127.

Compared with the related art, in the speaker 100 provided by the present disclosure, the space for filling the sound absorbing powder includes the first sound absorbing cavity 124 defined by the breathable spacer 14 and the lower housing 12, and the second sound absorbing cavity 114 provided in the upper housing 11. The second sound absorbing cavity 114 is in communication with the first sound absorbing cavity 124, so that the filling space of the speaker is effectively increased, thereby improving the acoustic effect of the speaker.

The above are merely embodiments of the present disclosure. Here, it should be noted that those skilled in the art can make modifications without departing from the inventive concept of the present disclosure, but these shall fall into the protection scope of the present disclosure.

What is claimed is:

1. A speaker, comprising:

an upper housing;

a lower housing assembled with the upper housing to define a receiving space; and a speaker unit received in the receiving space and comprising a diaphragm that is spaced apart from the upper housing to form a front cavity, wherein the upper housing comprises a top wall facing and spaced apart from the diaphragm, a side wall extending from the top wall towards the lower housing, and a first blocking wall extending from the top wall along a direction facing away from the top wall and spaced apart from the side wall, wherein the first blocking wall, the side wall and the top wall define a receiving portion for receiving the speaker unit, a breathable spacer is provided at an end of the receiving portion facing away from the top wall, the breathable spacer encapsulates the speaker unit in the receiving portion, the lower housing is spaced apart from the breathable spacer to form a first sound absorbing cavity for receiving a sound absorbing material, a side of the first blocking wall facing away from the speaker unit, the side wall, and the lower housing define a second sound absorbing sound cavity for receiving the sound absorbing material, and the first sound absorbing cavity is in communication with the second sound absorbing cavity.

2. The speaker as described in claim 1, wherein the lower housing is provided with a filling hole at a position corresponding to the first sound absorbing cavity and the filling hole extends through the lower housing, and the sound absorbing material is placed into the first sound absorbing cavity and the second sound absorbing cavity through the filling hole.

3. The speaker as described in claim 2, wherein the lower housing is provided with a sealing sheet covering the filling hole.

4. The speaker as described in claim 1, wherein the lower housing comprises a bottom wall facing the top wall, a side plate extending from the bottom wall towards the top wall, and a second blocking wall extending from the bottom wall into the receiving space, the second blocking wall is correspondingly welded to the first blocking wall, the side plate is correspondingly welded to the side wall, and the breathable spacer is fixed to the second blocking wall by hot melting.

5. The speaker as described in claim 4, wherein the lower housing further comprises a abutting portion extending from the bottom wall towards the speaker unit, and the breathable spacer is fixed to the abutting portion.

6. The speaker as described in claim 5, further comprising a buffer member, wherein the breathable spacer is fixed to a periphery of the abutting portion, and is provided with a hollow portion corresponding to the abutting portion, the buffer member is provided under the hollow portion and abuts against the speaker unit, and the abutting portion abuts against the buffer member after partially passing through the hollow portion.

7. The speaker as described in claim 4, wherein the second blocking wall is provided with a communication port that communicates the first sound absorbing cavity with the second sound absorbing cavity.

8. The speaker as described in claim 4, wherein the first blocking wall is fixed to the second blocking wall by ultrasonic welding or laser welding, and the side wall is fixed to the side plate by ultrasonic welding or laser welding.

9. The speaker as described in claim 4, wherein the bottom wall comprises a plastic body and a metal plate embedded in the plastic body, the metal plate and the plastic body being injection-molded into one piece.

10. The speaker as described in claim 1, wherein the upper housing is correspondingly provided with a sound outlet communicating with the front cavity.

* * * * *